US007942517B2

(12) United States Patent
McConville et al.

(10) Patent No.: US 7,942,517 B2
(45) Date of Patent: May 17, 2011

(54) METHOD FOR LUBRICATING A TRANSFER ROLLER WITH AN IMAGE MEMBER

(75) Inventors: Paul John McConville, Webster, NY (US); Trevor James Snyder, Newberg, OR (US); Jeffrey Russell Kohne, Tualatin, OR (US); Brent Edward Fleming, Aloha, OR (US); Michael Eugene Jones, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/886,546

(22) Filed: Sep. 20, 2010

(65) Prior Publication Data

US 2011/0005419 A1 Jan. 13, 2011

Related U.S. Application Data

(62) Division of application No. 11/880,560, filed on Jul. 23, 2007, now Pat. No. 7,798,631.

(51) Int. Cl.
*B41J 2/01* (2006.01)
*B41J 29/38* (2006.01)

(52) U.S. Cl. ..... 347/103; 347/5; 347/101; 347/102

(58) Field of Classification Search ..... 347/5, 102, 347/103

See application file for complete search history.

(56) References Cited

U.S. PATENT DOCUMENTS

| | | | | |
|---|---|---|---|---|
| 6,585,368 | B1 | 7/2003 | Park | |
| 6,731,891 | B1 | 5/2004 | Calamita et al. | |
| 6,986,575 | B1 | 1/2006 | Gordon et al. | |
| 7,543,901 | B2 | 6/2009 | Snyder et al. | |
| 2004/0001917 | A1 | 1/2004 | Urlaub et al. | |
| 2005/0150397 | A1 | 7/2005 | Park et al. | |
| 2005/0150398 | A1 | 7/2005 | Park et al. | |
| 2006/0001723 | A1 | 1/2006 | Gordon et al. | |
| 2006/0238585 | A1 | 10/2006 | Kohne et al. | |
| 2006/0250467 | A1 | 11/2006 | Folkins | |
| 2007/0084366 | A1 | 4/2007 | Costanza et al. | |
| 2007/0103531 | A1 * | 5/2007 | Jones et al. | 347/103 |
| 2007/0109383 | A1 | 5/2007 | Folkins et al. | |
| 2007/0139496 | A1 | 6/2007 | Leighton et al. | |

* cited by examiner

*Primary Examiner* — Ryan Lepisto

(74) *Attorney, Agent, or Firm* — Maginot, Moore & Beck LLP

(57) ABSTRACT

A method is implemented by a printer to move a transfix roller selectively to clean the transfix roller. The transfix roller is moved from a transfix nip with the print drum to a position where the transfix roller remains in rolling contact with the print drum, but exerts a pressure on the print drum that is less than the transfix pressure. The transfix roller is later moved out of rolling contact with the print drum in response to the transfix roller rotating a predetermined distance.

13 Claims, 5 Drawing Sheets

METHOD FOR LUBRICATING A TRANSFER ROLLER WITH AN IMAGE MEMBER

CLAIM OF PRIORITY

This application claims priority from U.S. patent application Ser. No. 11/880,560 entitled "System And Method For Lubricating A Transfer Roller With An Image Member" that was filed on Jul. 23, 2007 and which issued as U.S. Pat. No. 7,798,631 on Sep. 21, 2010.

TECHNICAL FIELD

This disclosure relates generally to printers having an intermediate imaging member and, more particularly, to the components and methods for transferring an image from an intermediate imaging member to print media.

BACKGROUND

Solid ink or phase change ink printers conventionally receive ink in a solid form, either as pellets or as ink sticks. The solid ink pellets or ink sticks are placed in a feed chute and a feed mechanism delivers the solid ink to a heater assembly. Solid ink sticks are either gravity fed or pushed by a mechanism through the feed chute toward a heater plate in the heater assembly. The heater plate melts the solid ink impinging on the plate into a liquid that is delivered to a print head for jetting onto a recording medium.

In known printing systems having an intermediate imaging member, the print process includes an imaging phase, a transfer phase, and an overhead phase. In ink printing systems, the imaging phase is the portion of the print process in which the ink is expelled through the piezoelectric elements comprising the print head in an image pattern onto the print drum or other intermediate imaging member. The transfer or transfix phase is the portion of the print process in which the ink image on the print drum is transferred to the recording medium. The image transfer typically occurs by bringing a transfer roller into contact with the image member to form a nip. A recording medium arrives at the nip as the print drum rotates the image through the nip. The pressure in the nip helps transfer the malleable image inks from the print drum to the recording medium. In the overhead phase, the trailing edge of the recording medium passes out of the nip and the transfer roller is released from contacting the image member. Because the rotation of the transfer roller is driven by the rotation of the print drum, releasing the transfer roller from the image member substantially reduces the load on the electrical motor driving the image member. In this manner, the electrical energy consumed by the motor is reduced.

Printing may be performed in a simplex or duplex manner. Simplex printing occurs as an image is transferred from the image member to one side only of the recording medium. Duplex printing involves printing an image on each side of the recording medium. In duplex printing, the recording medium passes through the nip between the transfer roller and the print drum. The recording medium then is directed into a path that returns the recording medium to the nip so the side that was not printed during the first pass faces the print drum. As the recording medium goes through the nip the second time, an image is transferred to the unprinted side of the recording medium. The recording medium then exits the nip and is routed to the output tray. Additionally, treatment of the printed recording medium may occur as the printed medium progresses from the transfer nip to the output tray.

One issue that arises during duplex printing in ink printers is a condition called ghosting. To facilitate transfer of an ink image from a print drum to a recording medium, a drum maintenance system is provided to apply release agent to the surface of the print drum before ink is ejected onto the print drum. Release agent is typically silicone oil that is applied to the print drum by an applicator roll in the drum maintenance system that may be partially submerged in a release agent sump. A blade may be positioned at a location following the drum maintenance system to remove excess release agent from the print drum. The release agent provides a thin layer on which an image is formed so the image does not adhere to the print drum. During a series of simplex print operations, the transfer roller obtains little, if any, release agent from the print drum as the transfer roller is primarily in contact with the unprinted side of the recording medium. Consequently, the transfer roller effectively "dries out." In this condition, the transfer roller may acquire ink from the printed side of the recording medium as it passes through the nip during the second pass of a duplex printing. That is, the relatively dry state of the transfer roller and the pressure in the nip may cause some of the ink and/or release agent from the side of the recording medium printed during the first pass of the medium through the nip in a duplex operation to migrate to the transfer roller. The presence of ink or release agent on an otherwise dry transfer roller produces a non-uniform surface on the transfer roller. On the next revolution of the transfer roller, the non-uniformity of the transfer roller causes different adhesion of the ink in the next image to the next recording medium that enters the transfer nip. The appearance caused by the different adhesions is sometimes called ghosting.

In an effort to address ghosting, attempts have been made to apply release agent to the transfer roller prior to commencing a duplex printing operation. One way of applying release agent to the transfer roller is to allow the transfer roller and image member to rotate together for one full revolution of the transfer roller before commencing the duplex operation. The amount of the release agent applied in this manner has been found to be generally insufficient. Allowing the transfer roller and the image member to rotate together for multiple revolutions has also provided unsatisfactory results because the transfer roller sometimes obtains too much release agent and transfer of the image to the recording medium during the duplex operation is adversely impacted. Another approach requires interruption of a series of simplex prints to apply release agent to the transfer roller using the print drum. Interrupting a series of simplex printings to apply release agent reduces the throughput of the printer and increases the time to process a queue of simplex printings. Being able to apply enough release agent to a transfer roller to reduce ghosting effects during duplex operations without reducing productivity during simplex operations is desirable in solid ink printers.

SUMMARY

A printer and method have been developed that adequately apply release agent to a transfer roller to reduce ghosting during duplex operations without reducing output production during simplex operations. The printer includes a print drum for receiving ink ejected by a print head, a release agent applicator located proximate to the print drum to apply release agent to the print drum, a transfix roller located proximate to the print drum, a displaceable linkage coupled to the transfix roller to move the transfix roller into and out of contact with the print drum, a controller coupled to the displaceable linkage for generating signals that cause the displaceable linkage to move the transfix roller, the controller being configured to generate a transfix signal, a roll-off signal, and a release signal, and the displaceable linkage responds to the transfix signal to move the transfix roller to form the transfix nip with the print drum, the displaceable linkage responds to the roll-off signal to move the transfix roller away from the print drum so the transfix roller remains in rolling contact with the print drum with reduced pressure being exerted on the print drum, and the displaceable linkage responds to the release signal to move the transfix roller out of rolling contact with the print drum.

A method that may be implemented with the printer includes moving a transfix roller to a position where the transfix roller contacts a print drum to form a transfix nip in which ink on the drum is transferred to media passing through the nip, and moving the transfix roller from the transfix nip position to a position where the transfix roller remains in rolling contact with the print drum and the transfix roller exerts a reduced pressure against the print drum. The rolling contact enabled by performance of this method helps keep the transfix roller adequately lubricated without adversely impacting print cycle speed.

BRIEF DESCRIPTION OF THE DRAWINGS

The foregoing aspects and other features of an ink printer implementing a forward direction printing process are explained in the following description, taken in connection with the accompanying drawings, wherein.

DETAILED DESCRIPTION

Figure 1:
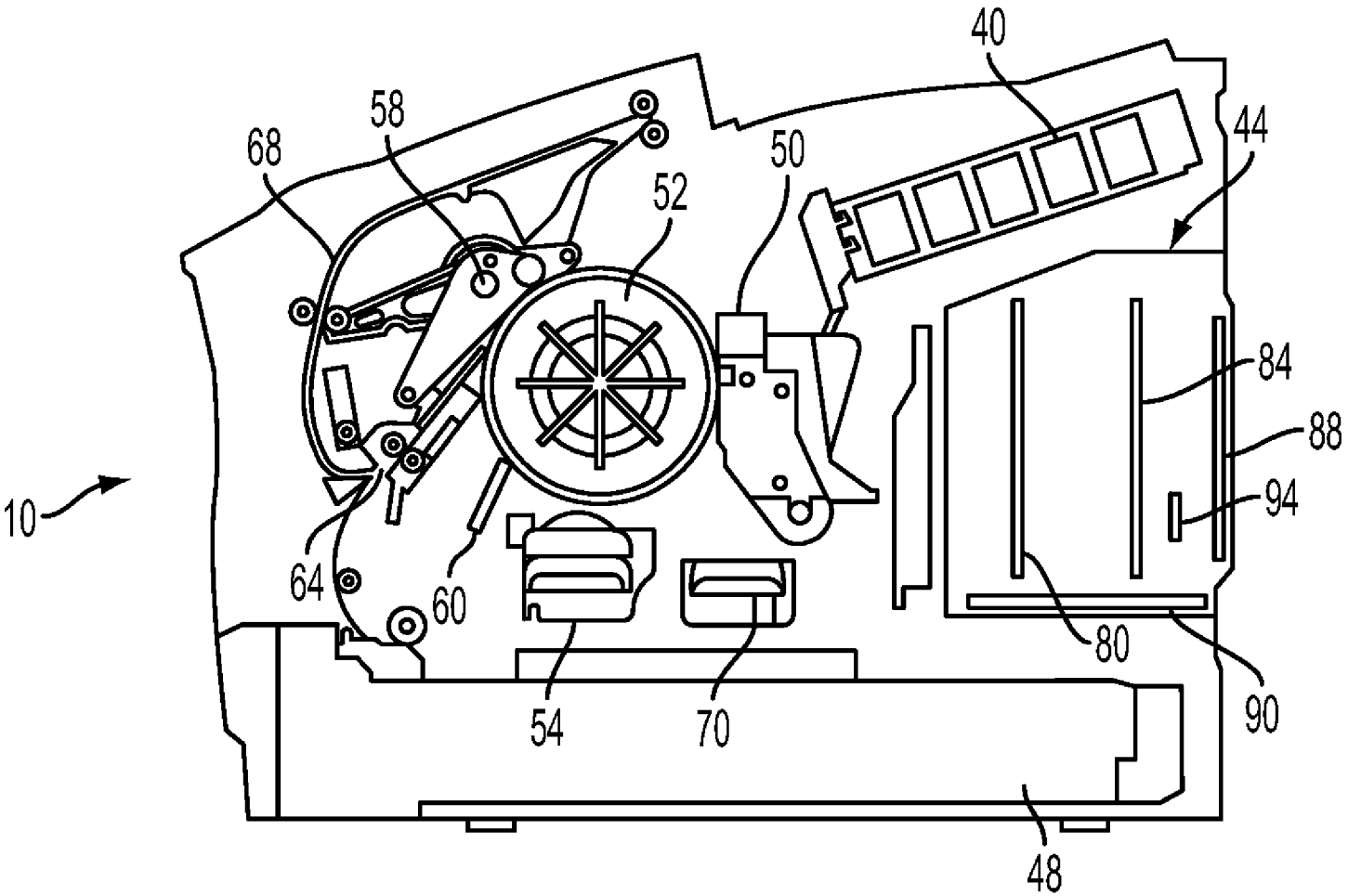
FIG. 1 PRIOR ART
FIG. 1 is a side view of the ink printer depicting the major subsystems of the ink printer.

Referring to FIG. 1, there is shown a perspective view of a prior art ink printer 10 that may be modified to implement a single direction print process that reduces the occurrence of ghosting conditions during duplex printing. The reader should understand that the embodiment of the print process discussed below may be implemented in many alternate forms and variations. In addition, any suitable size, shape or type of elements or materials may be used.

As shown in FIG. 1, the ink printer 10 may include an ink loader 40, an electronics module 44, a paper/media tray 48, a print head 50, an intermediate imaging member 52, a drum maintenance subsystem 54, a transfix subsystem 58, a wiper subassembly 60, a paper/media preheater 64, a duplex print path 68, and an ink waste tray 70. In brief, solid ink sticks are loaded into ink loader 40 through which they travel to a melt plate (not shown). At the melt plate, the ink stick is melted and the liquid ink is diverted to a reservoir in the print head 50. The ink is ejected by piezoelectric elements to form an image on the intermediate imaging member 52 as the member rotates. Member 52 is called an intermediate imaging member because an ink image is formed on the member and then transferred to media in the transfix subsystem. This printing process is a type of offsetting printing. The intermediate imaging member may also be called a print drum.

Figure 2:
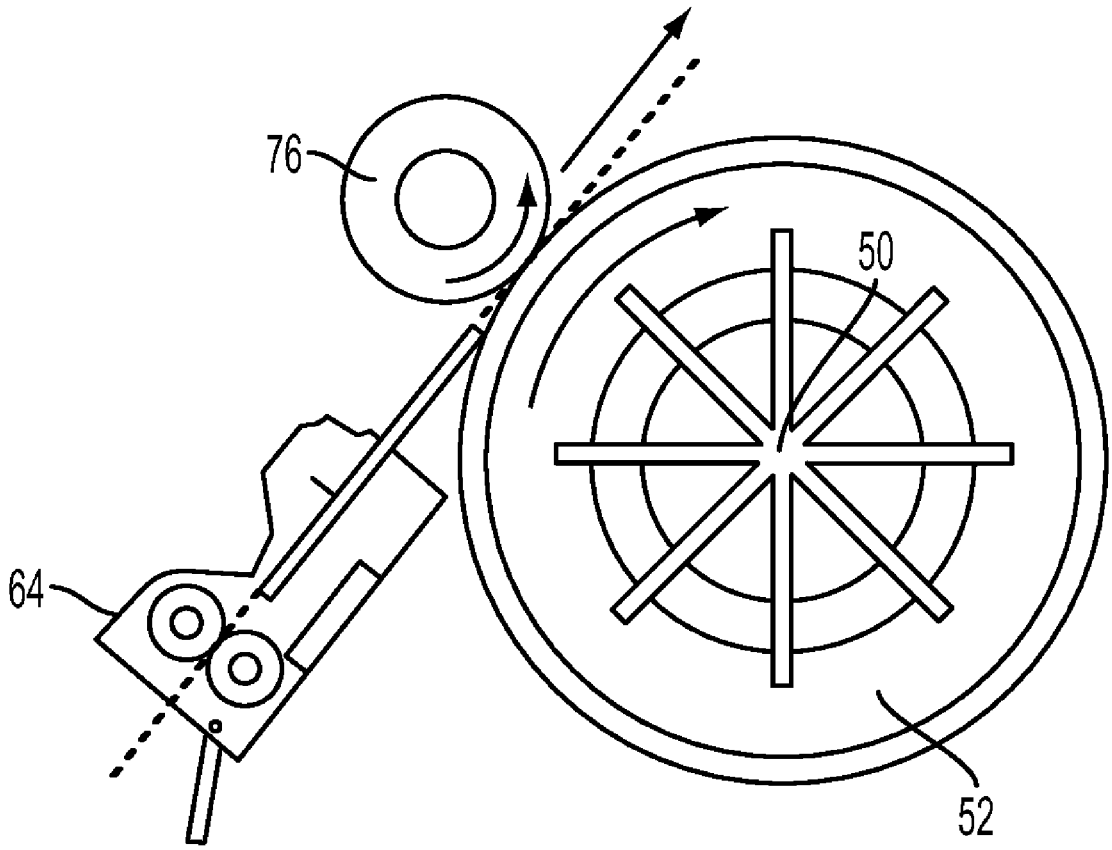
FIG. 2 PRIOR ART
FIG. 2 is a side view of the relationship between the transfer roller and the intermediate imaging member.

An intermediate imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfix roller in the transfer subsystem 58 and the intermediate image member 52 is coordinated for the transfer of the image from the imaging member to the sheet of recording media. The presentation of a recording media sheet between a transfer roller 76 and the intermediate imaging member 52 is shown in more detail in FIG. 2.

A duplex image includes a first image that is transferred from the intermediate imaging member onto a first side of a recording media sheet followed by a second image that is transferred from the intermediate imaging member onto the reverse side of the recording media sheet to which the first image was transferred. One problem that occurs in printing systems that apply a release agent to the intermediate imaging member is the contamination of the reverse side of a recording media sheet with release agent during the transfer of the first image onto the sheet. This contamination may then generate defects during the transfer of the second image on the reverse side of the recording media sheet. Alternatively, if the transfix roller is too dry, then differences in the surface of the transfix roller arise as the dry surface responds differently to ink or oil than it does to paper alone. These differences may cause differential gloss, or ghost, patterns to appear and print quality suffers. Thus, a balance needs to be achieved between too much and too little release agent on the transfix roller.

The operations of the ink printer 10 are controlled by the electronics module 44. The electronics module 44 includes a power supply 80, a main board 84 with a controller, memory, and interface components (not shown), a hard drive 88, a power control board 90, and a configuration card 94. The power supply 80 generates various power levels for the various components and subsystems of the ink printer 10. The power control board 90 regulates these power levels. The configuration card contains data in nonvolatile memory that defines the various operating parameters and configurations for the components and subsystems of the ink printer 10. The hard drive stores data used for operating the ink printer and software modules that may be loaded and executed in the memory on the main card 84. The main board 84 includes the controller that operates the ink printer 10 is configured in accordance with an operating program executing in the memory of the main board 84. The controller receives signals from the various components and subsystems of the ink printer 10 through interface components on the main board 84. The controller also generates control signals that are delivered to the components and subsystems through the interface components. These control signals, for example, drive the piezoelectric elements to expel ink from the print heads to form the image on the imaging member 52 as the member rotates past the print head.

The controller also generates control signals for operating the print drum motor that drives the print drum. In printers in which an image is transferred from the print drum to media in a transfix nip, the rotational speed of the print drum is slowed as the transfix roller is brought into contact with the print drum to reduce stress on the motor driving the print drum. To help ensure image transfer efficiency, the transfix roller is pressed against the print drum at the transfix nip. The pressure applied to each end of a transfix roller, in some printers, may be approximately 5000 newtons. As the trailing edge of a media sheet leaves the transfix nip and the transfix roller is moved out of contact with the print drum, the print drum motor is controlled to increase the rotational speed of the print drum up to its imaging speed. In one type of printer, the print drum imaging speed is approximately 2000 mm/second and the transfix speed for the print drum is approximately 1000 mm/second.

Figure 3:
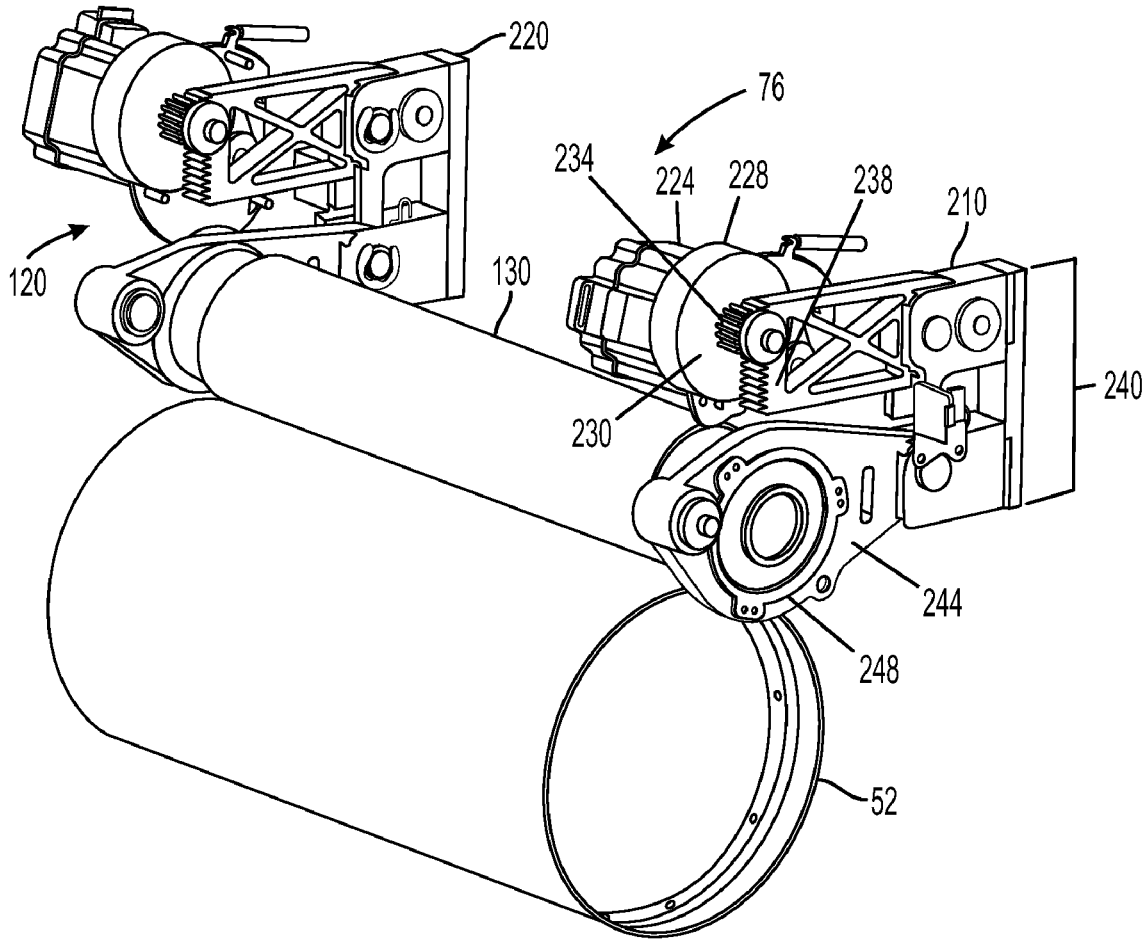
FIG. 3 is a perspective view of a transfix roller control system for moving a transfix roller with reference to a print drum.

A prior art transfix roller control system 120 for moving a transfix roller 76 with respect to a print drum 52 is shown in FIG. 3. The system 120 includes a transfix roller control assembly 210 at one end of the transfix roller 130 and a transfix roller control assembly 220 at the other end of the transfix roller 130. As the transfix roller control assemblies 210 and 220 are essentially the same, the following description is directed to roller control assembly 210 only. The assembly 210 includes a motor 224 having a pulley (not shown) on its output shaft. An endless belt 228 is wound around the pulley on the output shaft of the motor 224 and pulley 230. At its center, pulley 230 has gear splines 234 that engage teeth of a sector gear 238. At the outboard end of sector gear 238, a link 240 to a retainer arm 244 is mounted. With the retainer arm 244 is an opening with a journal bearing 248 mounted therein to receive one end of the transfix roller 76. The transfix roller control assembly 220 is similarly arranged.

When the controller generates a signal to operate the motor 224, its output shaft rotates causing the endless belt 228 to rotate the pulley 230. As pulley 230 rotates, the gear splines 234 vertically move the sector gear 238. Link 240 at the outboard of the sector gear 238 urges the retainer arm 244 to move in the same direction as the sector gear 238. Thus, the journaled end of the transfix roller is moved by bi-directional control of the motor 224. Operation of the motor 224 in the assembly 210 and the corresponding motor in the assembly 220 is coordinated by the controller so the transfix roller 76 moves smoothly into and out of engagement with the print drum 102. The assemblies 210 and 220 may also include pressure sensors, such as a strain gauge, in the link 240. The sensor provides an indication of the pressure being exerted by the transfix roller 76 against the print drum 52. The pressure signal may be used by the controller as feedback for regulation of the signals controlling the motors in the assemblies 210 and 220.

While one embodiment of a transfix roller control assembly has been described, other embodiments may be used. The other embodiments may be comprised of an roller control assembly for each end of a transfix roller or it may be comprised of a single assembly that controls both ends of the transfix roller. What is required of the various transfix roller control embodiments is that the transfix roller control operate as a displaceable linkage to move the transfix roller into and out of engagement with the print drum in response to control signals that move the linkage through a range of motion. The range of motion is defined at one end as being disengaged from the print drum and, at the other end of the range, as being pressed against the print drum with sufficient pressure to form a transfer nip. The system and method described more fully below operates the displaceable linkage so the transfix roller is moved to a position intermediate the transfer nip and disengaged positions so the transfix roller remains in contact with the print drum at a reduced pressure. In this position, the transfix roller obtains release agent from the print drum during simplex printing operations without slowing the return of the print drum to printing speeds.

Figure 4:
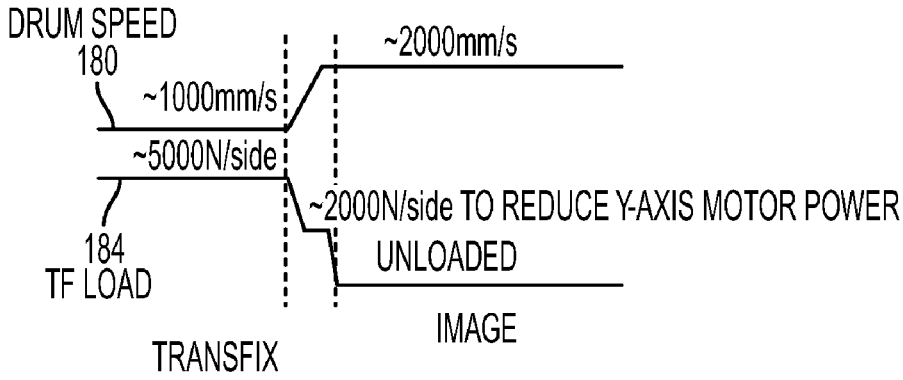
FIG. 4 is a graph depicting the relationship between rotational speed of a print drum and the pressure exerted by a transfix roller with respect to the position of the transfix roller relative to the print drum.

In an improved printer that helps prevent the transfix roller 76 from becoming too dry without placing too much release agent on the transfix roller or adversely impacting the speed of the print cycle, the transfix roller 76 is moved to an intermediate position. At the intermediate position, the transfix roller remains in rolling contact with the print drum 52 at a reduced pressure. The relationship between print drum speed and transfix roller pressure is shown in FIG. 4. The surface speed of the print drum is depicted by line 180 and the pressure exerted by the transfix roller 76 against the print drum 52 is shown by line 184. During a transfix operation, the transfix roller, in one embodiment, exerts approximately 5000 N on each side of the transfix roller while the print drum rotates at approximately 1000 mm/second. As the trailing edge of the sheet in the nip leaves the transfix nip and the print drum motor begins to increase the rotational speed of the print drum to its imaging speed of approximately 2000 mm/second, the controller generates a roll-off signal that is delivered to the motors in assemblies 210 and 220, for example. The motor responds to the roll-off signal by rotating a portion of the distance that moves the transfix roller to the disengaged position. The motor stops rotating when the intermediate position has been reached. At that position, the transfix roller exerts a pressure against the print drum of about 2000 N. This positioning of the transfix roller enables the print drum to continue to ramp to the imaging speed without excessive loading of the print drum motor. Additionally, the transfix roller remains in rolling contact with the print drum. Because no media is present in the nip, some of the release agent on the print drum is transferred to the transfix roller by the rolling contact between the transfix roller and the print drum. The controller terminates the roll-off signal upon detection of the transfix roller rotating a roll-off distance. The roll-off distance may be detected by counting a time period commencing at the generation of the roll-off signal and determining the rotational speed of the transfix roller from the speed of the print drum. The print drum speed is measured with a rotational speed encoder (not shown), which is coupled to the shaft extending from the longitudinal axis of the print drum. The roll-off distance is selected to be a distance that can be reached during a time period that does not increase the time required to transition the print drum from the transfix phase to the imaging phase. The controller is configured to terminate the roll-off signal when the roll-off distance has been reached. Termination may include cessation of roll-off signal generation or generation of the release signal. The motor in an assembly responds to the release signal by rotating the sector gear 238 to continue movement of the transfix roller 76 away from the print drum 52 to the release position so the transfix roller 76 no longer contacts the print drum 52.

Figure 5:
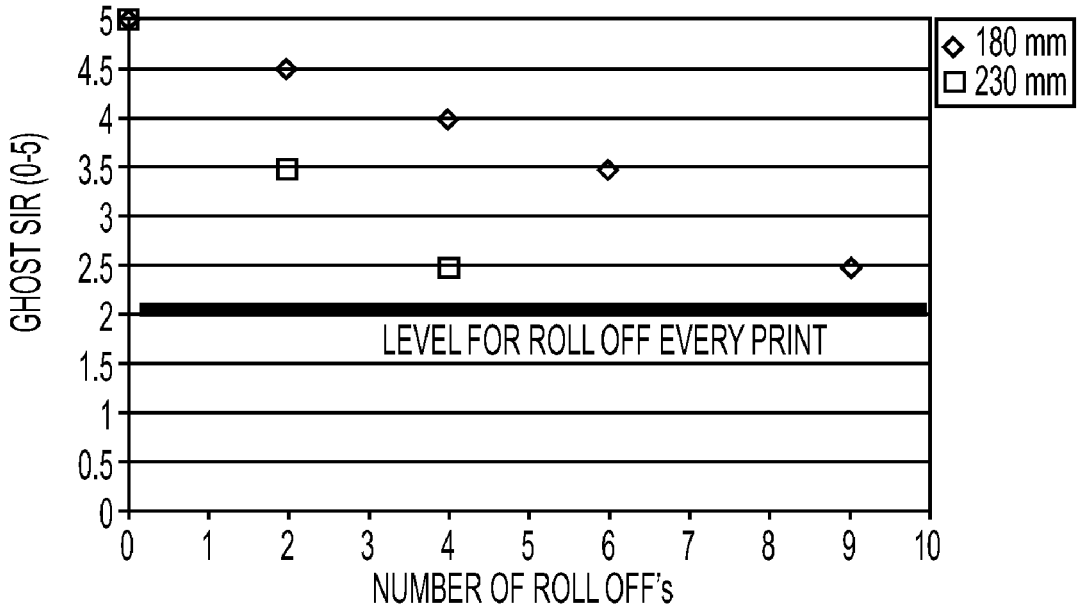
FIG. 5 is a graphical comparison of the number of roll-off operations required to cover a print drum adequately to achieve a particular level of ghosting condition.

Adequately providing release agent to the entire surface of the transfix roller is a function of the roll-off distance and the frequency of roll-off signal generation. A comparison of the minimum number of roll-offs required at two roll-off distances to achieve various levels of ghosting conditions is shown in FIG. 5. The solid line depicts a roll-off signal generation for each print cycle performed by a printer. Operating the transfix roller in this manner yields the lowest ghosting conditions. As shown in the figure, nine (9) roll-offs at a distance of 180 mm each is required to reach the ghosting condition level provided by four (4) roll-offs at a distance of 230 mm each. While the ghosting level condition reached by these roll-off operations is not as good as a roll-off operation being performed for each print cycle, the level achieved is close enough to provide adequate ghost condition levels without requiring every print cycle to include a roll-off operation.

The controller may be a general purpose microprocessor that executes programmed instructions that are stored in a memory. The controller also includes the interface and input/output (I/O) components for receiving status signals from the printer and supplying control signals to the printer components. Alternatively, the controller may be a dedicated processor on a substrate with the necessary memory, interface, and I/O components also provided on the substrate. Such devices are sometimes known as application specific integrated circuits (ASIC). The controller may also be implemented with appropriately configured discrete electronic components or primarily as a computer program or as a combination of appropriately configured hardware and software components.

At the commencement of each print cycle, the controller determines whether a roll-off operation is to be performed at the end of the transfix phase of the cycle. In order to make this determination, the controller is configured to evaluate whether conditions for a roll-off operation have been detected. One roll-off condition is whether the transfix roller has rotated a distance that dries the transfix roller since the controller last generated a roll-off signal. The transfix roller rotational distance may be computed from the rotational speed of the transfix roller. The speed of the transfix roller is related to the rotational speed of the print drum, which can be calculated from the print drum encoder signal. Thus, the controller is configured to accumulate the distance that the transfix roller has rotated since the last roll-off signal was terminated. When this accumulated distance exceeds an empirically determined distance corresponding to occurrence of a dry transfix roller, the controller generates a roll-off signal at the end of the transfix phase.

Another detected condition that indicates a roll-off operation should occur is when the difference between a sheet queue length and a distance for cleaning the transfix roller is less than the distance for cleaning the transfix roller and the sheet queue length is greater than a distance for cleaning the transfix roller. The sheet queue length is the length of the sheets in a queue to be printed, not counting the one to be printed in the current print cycle. The distance for cleaning the transfix roller is the distance required for reaching the target ghost level. For example, using the roll-off distance of 230 mm and four operations to reach the best ghost level, as shown in FIG. 4, the transfix cleaning distance is (4×230 mm) or 920 mm. If the distance between the sheet queue length and the cleaning distance is less than the cleaning distance, then the last opportunity for a roll-off operation during the printing of the queue has been reached. By also detecting that the sheet queue length is greater than the cleaning distance, enough roll-off operations can be performed to adequately cover the transfix roller. Once the sheet queue length is less than the cleaning distance, a roll-off operation is not commenced as there is an inadequate number of sheets to enable the transfix roller to be adequately covered. When this roll-off condition is detected, a roll-off signal is generated by the controller for the current print cycle and the distance since the last roll-off operation is reset to zero.

In one embodiment of a printer that moves the transfix roller to an intermediate position between a transfix nip and a release position, the controller generates a roll-off signal in response to detection of either one of the two roll-off conditions described above. In this embodiment, the controller generates a roll-off signal in response to the transfix roller having rotated a distance that dries the transfix roller since the controller last generated a roll-off signal, or in response to a sheet queue length being greater than a distance for cleaning the transfix roller and the difference between the sheet queue length and the distance for cleaning the transfix roller being less than the distance for cleaning the transfix roller.

Figure 6:
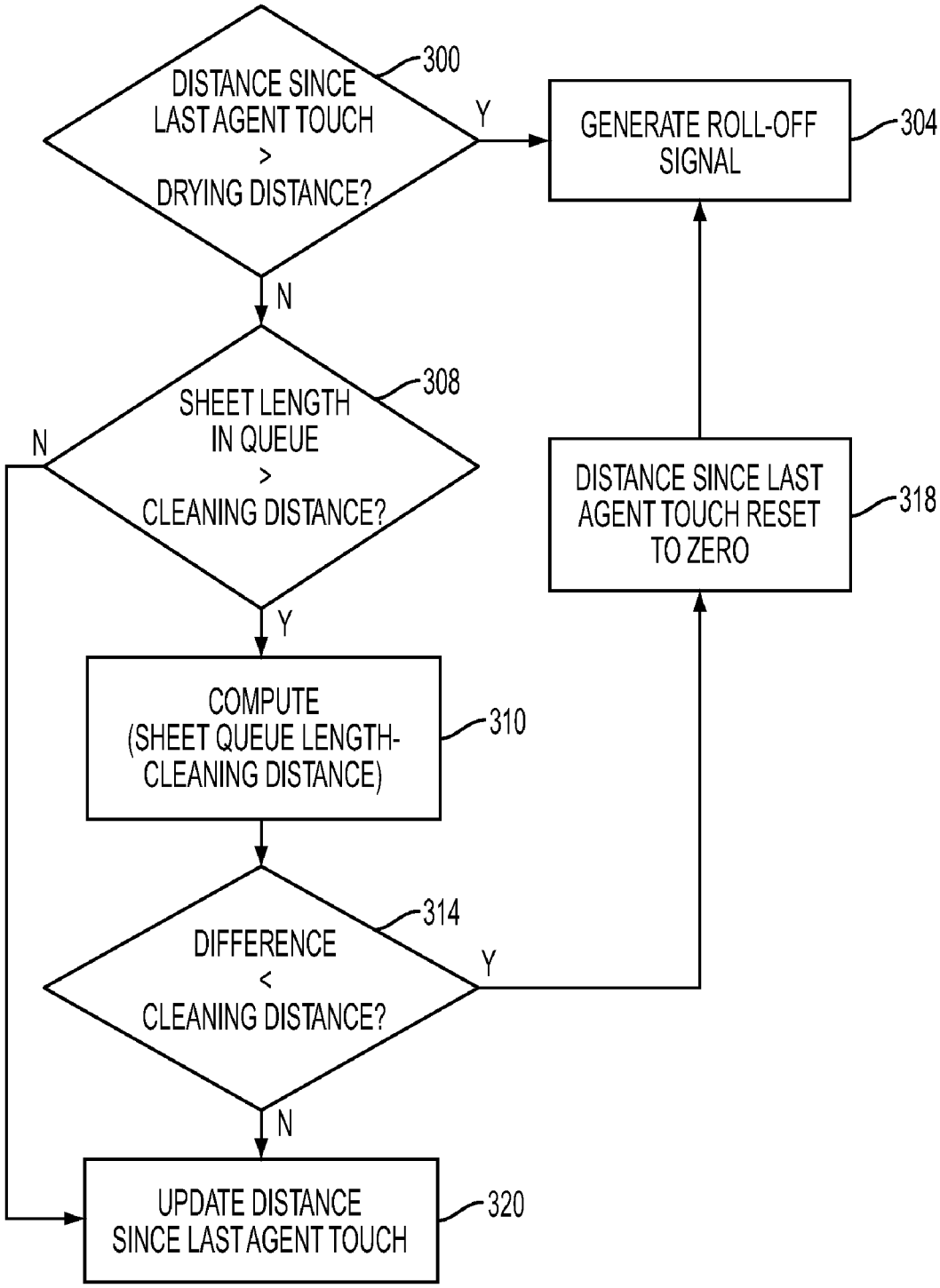
FIG. 6 is a flow diagram of a process for determining whether a roll-off operation is to be performed.

An exemplary method performed by a controller configured to generate a roll-off signal in response to detection of one or more roll-off conditions is shown in FIG. 6. The method is performed at the start of each print cycle. The accumulated distance that the transfix roller has rotated since the generation of the last roll-off signal is compared to the distance in which the transfix roller dries if no roll-off operation occurs (block 300). If the accumulated distance is greater than the drying distance, the roll-off signal is generated (block 304). If the accumulated distance is less than the drying distance, the sheet queue length is compared to the distance for adequately covering the transfix roller with release agent (block 308). If the sheet queue length is greater than this cleaning distance, the difference between the sheet queue length and the cleaning distance is computed (block 310) and the difference is compared to the cleaning distance (block 314). If the difference is less than the cleaning distance, the distance since the last roll-off operation is reset to zero (block 318) and the roll-off signal is generated (block 304). Otherwise, the accumulated distance is updated using the distance measured by the encoder since the last distance update (block 320). The controller then continues other processing until the next print cycle.

The method may be described in pseudo-code as follows:

```
[If tfixLastTouchLength > tfixRollWantExtraRollOffLength OR
(CurrentSheetQueLength- tfixRollCleanupLength) < tfixRollCleanupLength AND
CurrentSheetQueLength > tfixRollCleanupLength Then Roll-Off Extra Distance
and reset tfixLastTouchLength =0
Else
No Roll-Off]
where:
tfixLastTouchLength=distance in mm since the transfix roller was last in contact
with the oiled drum, not counting this sheet.
CurrentSheetQueLength=distance in mm of simplex media length in queue not
counting this sheet.
tfixRollCleanupLength= distance in mm needed to clean the transfix roller prior to
duplex operations.
tfixRollWantExtraRollOffLength= distance in mm between completion of one
transfix cleaning operation and the commencement of the next transfix cleaning
operation.
```

While the printer 10 has been described as being a solid ink printer, the controller may be configured to move the transfix roller to an intermediate position between the release position and the transfix nip in other printer in which an image is transferred from one member to another member or media in a selectively formed nip. Those skilled in the art will recognize that numerous modifications can be made to the specific implementations described above. Those skilled in the art will recognize that the single direction print process and release agent control may be adapted for other printers using an intermediate imaging member, such as xeroxographic printers or offset lithographic printers. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

We claim:

1. A method for moving a transfix roller during a print cycle comprising:

moving a transfix roller to a first position where the transfix roller contacts a print drum to form a transfix nip with the print drum and exerts a first pressure on the print drum to transfer an image from the print drum to media passing through the transfix nip;

moving the transfix roller from the first position to a second position where the transfix roller remains in rolling contact with the print drum and the transfix roller exerts a second pressure on the print drum that is less than the first pressure; and moving the transfix roller out of rolling contact with the print drum in response to the transfix roller rotating a predetermined distance after the transfix roller reaches the second position from the first position.

2. The method of claim 1 further comprising:

maintaining the transfix roller at the second position until the transfix roller has rolled the predetermined distance past a trailing edge of the media that passed through the transfix nip.

3. The method of claim 2 further comprising:

detecting a roll-off condition; and the movement of the transfix roller to the second position where the transfix roller exerts the second pressure is made in response to the detection of the roll-off condition.

4. The method of claim 3, the roll-off condition detection further comprising:

measuring a distance of transfix roller rotation since the transfix roller was last in the second position; and detecting the roll-off condition in response to the measured distance being greater than a distance that enables the transfix roller to dry.

5. The method of claim 3, the roll-off condition detection further comprising:

measuring a length of media in a queue to be printed;

measuring a difference between the measured media length and a distance that enables the transfix roller to be cleaned; and detecting the roll-off condition in response to the measured media length being greater than the distance that enables the transfix roller to be cleaned and the measured difference being less than the distance that enables the transfix roller to be cleaned.

6. The method of claim 2 further comprising:

detecting one of two roll-off conditions; and the movement of the transfix roller to the second position is made in response to the detection of one of the two roll-off conditions.

7. The method of claim 6, the roll-off condition detection further comprising:

measuring a distance of transfix roller rotation since the transfix roller was last in the second position;

measuring a length of media in a queue to be printed;

comparing the measured media length to a distance that enables the transfix roller to be cleaned;

measuring a difference between the measured media length and the distance that enables the transfix roller to be cleaned; and detecting one of the two roll-off conditions in response to the measured distance being greater than the distance that enables the transfix roller to dry or in response to the measured media length being greater than the distance that enables the transfix roller to be cleaned and the measured difference being less than the distance that enables the transfix roller to be cleaned.

8. A method for moving a transfix roller during a print cycle comprising:

moving a transfix roller to a first position where the transfix roller contacts a print drum to form a transfix nip with the print drum and exerts a first pressure on the print drum to transfer an image from the print drum to media passing through the transfix nip;

moving the transfix roller from the first position to a second position where the transfix roller remains in rolling contact with the print drum and the transfix roller exerts a second pressure on the print drum that is less than the first pressure;

maintaining the transfix roller at the second position until the transfix roller has rolled the predetermined distance past a trailing edge of the media that passed through the transfix nip; and moving the transfix roller out of rolling contact with the print drum in response to the transfix roller rotating a predetermined distance.

9. The method of claim 8 further comprising:

detecting a roll-off condition; and the movement of the transfix roller to the second position where the transfix roller exerts the second pressure is made in response to the detection of the roll-off condition.

10. The method of claim 9, the roll-off condition detection further comprising:

measuring a distance of transfix roller rotation since the transfix roller was last in the second position; and detecting the roll-off condition in response to the measured distance being greater than a distance that enables the transfix roller to dry.

11. The method of claim 10, the roll-off condition detection further comprising:

measuring a length of media in a queue to be printed;

measuring a difference between the measured media length and a distance that enables the transfix roller to be cleaned; and detecting the roll-off condition in response to the measured media length being greater than the distance that enables the transfix roller to be cleaned and the measured difference being less than the distance that enables the transfix roller to be cleaned.

12. The method of claim 8 further comprising:

detecting one of two roll-off conditions; and the movement of the transfix roller to the second position is made in response to the detection of one of the two roll-off conditions.

13. The method of claim 12, the roll-off condition detection further comprising:

measuring a distance of transfix roller rotation since the transfix roller was last in the second position;

measuring a length of media in a queue to be printed;

comparing the measured media length to a distance that enables the transfix roller to be cleaned;

measuring a difference between the measured media length and the distance that enables the transfix roller to be cleaned; and detecting one of the two roll-off conditions in response to the measured distance being greater than the distance that enables the transfix roller to dry or in response to the measured media length being greater than the distance that enables the transfix roller to be cleaned and the measured difference being less than the distance that enables the transfix roller to be cleaned.

* * * * *